US007629552B2

(12) United States Patent
Hanson et al.

(10) Patent No.: US 7,629,552 B2
(45) Date of Patent: Dec. 8, 2009

(54) COLLAPSIBLE AND EXPANDABLE HOLDER AND SYSTEM FOR USING THE SAME

(75) Inventors: Bruce H. Hanson, Endicott, NY (US); J. Edward Roth, Lansdale, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 804 days.

(21) Appl. No.: 10/836,193

(22) Filed: May 3, 2004

(65) Prior Publication Data

US 2005/0241968 A1 Nov. 3, 2005

(51) Int. Cl.
*B07C 5/00* (2006.01)
*B65D 6/00* (2006.01)

(52) U.S. Cl. ..... 209/584; 220/6

(58) Field of Classification Search ..... 209/584, 209/900; 232/1 A, 24, 25, 26, 27, 38; 220/6, 220/7, 629, 558, 810, 848, 4.22, 9.2, 9.3; 206/557, 564, 600; 43/105; 119/431, 461, 119/474, 463, 513, 491, 498, 504; 224/586; 211/126.6, 130.1, 132.1, 195
See application file for complete search history.

(56) References Cited

U.S. PATENT DOCUMENTS 335,119 A * 2/1886 Flint ..... 220/6
3,726,469 A * 4/1973 Koehler ..... 229/117.03
4,509,635 A * 4/1985 Emsley et al. ..... 198/370.03
4,554,873 A * 11/1985 Rex ..... 104/88.04
5,625,978 A * 5/1997 Streeper et al. ..... 43/105
5,833,076 A 11/1998 Harres et al.
5,857,830 A 1/1999 Harres et al.
6,026,967 A 2/2000 Isaacs et al.
6,092,488 A * 7/2000 Allawas ..... 119/497
6,135,697 A 10/2000 Isaacs et al.
6,183,191 B1 2/2001 Mondie et al.
6,217,274 B1 4/2001 Svyatsky et al.
6,390,756 B1 5/2002 Isaacs et al.
6,762,382 B1 * 7/2004 Danelski ..... 209/583
6,802,503 B2 * 10/2004 Iida et al. ..... 270/58.29
6,997,138 B1 * 2/2006 Simpson ..... 119/499
2003/0080125 A1 * 5/2003 Cassani ..... 220/6
2003/0226789 A1 * 12/2003 Shiibashi et al. ..... 209/584

* cited by examiner

*Primary Examiner*—Patrick H Mackey
*Assistant Examiner*—Mark Hageman
(74) *Attorney, Agent, or Firm*—Greenblum & Bernstein PLC; Leland Schultz, Esq.

(57) ABSTRACT

An expandable and collapsible holder which has a top surface and a bottom, releasable surface. Opposing side walls are hinge mounted between the top surface and the bottom surface. A latch mechanism and actuator such as a solenoid control the opening of the bottom, releasable surface. A system is also provided which uses the expandable holder.

28 Claims, 6 Drawing Sheets

COLLAPSIBLE AND EXPANDABLE HOLDER AND SYSTEM FOR USING THE SAME

BACKGROUND OF THE INVENTION

1. Field of the Invention

The invention generally relates to holder and, in particular, to a collapsible and expandable holder and a system using the same.

2. Background Description

The delivery of mail such as catalogs, products, advertisements and a host of other articles have increased exponentially over the years. These mail pieces are known to be critical to commerce and the underlying economy. It is thus important to provide efficient delivery of such mail in both a cost effective and time efficient manner. This includes, for example, arranging randomly deposited mail pieces into a sequential delivery order for delivery to a destination point. By sorting the mail in a sequential order based on destination point, the delivery of mail and other articles can be provided in an orderly and effective manner.

In current sorting processes, optical character recognition systems may be used to capture delivery destination information. A host of feeders and other complex handling systems are then used to transport the mail to a host of bins or containers for sorting and future delivery. These handling systems include a transport track with a plurality of holders extending therefrom. The holders are designed to accommodate the mail pieces as they are transported from the feeders to a drop off point.

However, known holders are of a fixed size that, in use, has to be considerably larger than the mail pieces which are loaded therein. That is, the holders have to be designed to be larger than the largest mail piece to ensure that the largest mail piece can be captured within the holder for sequencing, transporting and drop off at a desired location. This larger design ensures that the mail piece can be placed within the holder from the feeder, without damaging the mail pieces or having a "failed" transfer. If there is a failed transfer, the entire system may have to be shut down in order to retrieve the mail piece. This, of course, will result in lost processing time, increased costs and other handling expenses.

These large fixed size holders are cumbersome, require a considerable amount of space and add to the overall use of the flooring space required by an accompanying system. As to the additional use of flooring space, it should be understood that the system, e.g., sequencer, has to be designed to accommodate these large fixed sized holders even though only a few of the mail pieces may be of a larger size. This, however, is not a very good use of flooring space considering that many of the mail pieces are smaller than that of the largest mail piece. Thus, in use, many of the holders are accommodating smaller sized mail pieces which results in a considerable amount of unused space in the holders and hence the system, as a whole.

SUMMARY OF THE INVENTION

In one aspect of the invention, an expandable and collapsible holder includes a top surface having opposing ends hinge mounted to opposing side surfaces, and a releasable bottom surface hinge mounted to the opposing side surfaces by at least a latch mechanism at an end remote from the top surface.

In another aspect of the invention, the holder includes a top wall and opposing side walls hinge mounted to ends of the top wall. A releasable bottom hinge is mounted to each of the opposing side walls, remote from the top wall. One of the hinges is a releasable latch mechanism. An actuator is positioned proximate to the releasable latch mechanism and is designed to control the opening of the releasable latch mechanism at a predetermined location or time.

In yet another aspect of the invention, a system is provided for sorting objects. The system includes a feeding station which feeds non-sequenced objects and at least one carriage movable in at least one direction. A plurality of expandable and collapsible holders hold and transport the objects fed from the feeding station. The expandable and collapsible holders have a releasable bottom portion for unloading the objects. At least one platform is in intermittent mechanical communication with the holders in order to expand the holders from a collapsible configuration resulting from placement of the objects therein.

In another aspect, a method is provided for sequencing objects. The method includes expanding, individually, a plurality of holders and placing non-sequenced mail pieces in separate expanded holders extending from a moveable carriage. Codes are assigned to at least one of the expanded holders and positions on the moveable carriage based on information associated with the non-sequenced mail pieces. The holders are collapsed after the mail pieces are placed therein. The holders are moved until the mail pieces therein are in a sequence based on the assigned codes. The holders are expanded and the mail pieces are unloaded.

DETAILED DESCRIPTION OF EMBODIMENTS OF THE INVENTION

The invention is directed to, for example, a collapsible and expandable holder and an accompanying system using such holder. The holder is designed to conserve flooring space in a handling facility such as, for example, a mail handling facility. In embodiments, the holder is designed to be utilized in other facilities and applications such as warehousing and the like, and may be designed to hold and transport any type of product. In one aspect of the invention, the holder is used in an accompanying sequencing system and method of use contemplated by the invention. In this system and method of the invention, overall length and working components can be considerably reduced conserving valuable user floor space and costs.

Embodiments of the Single Pass Sorting System

Figure 1A:
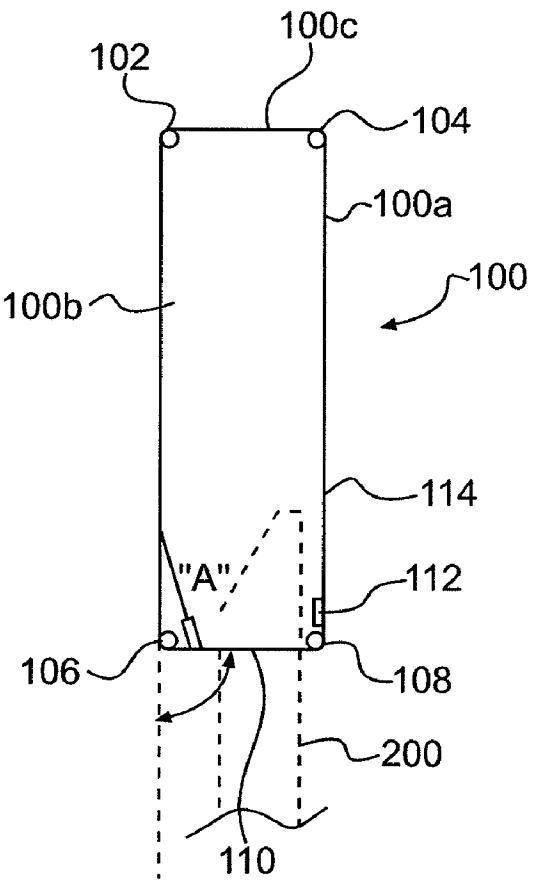
FIG. 1*a* shows a side view of a holder in accordance with the invention.
Figure 1B:
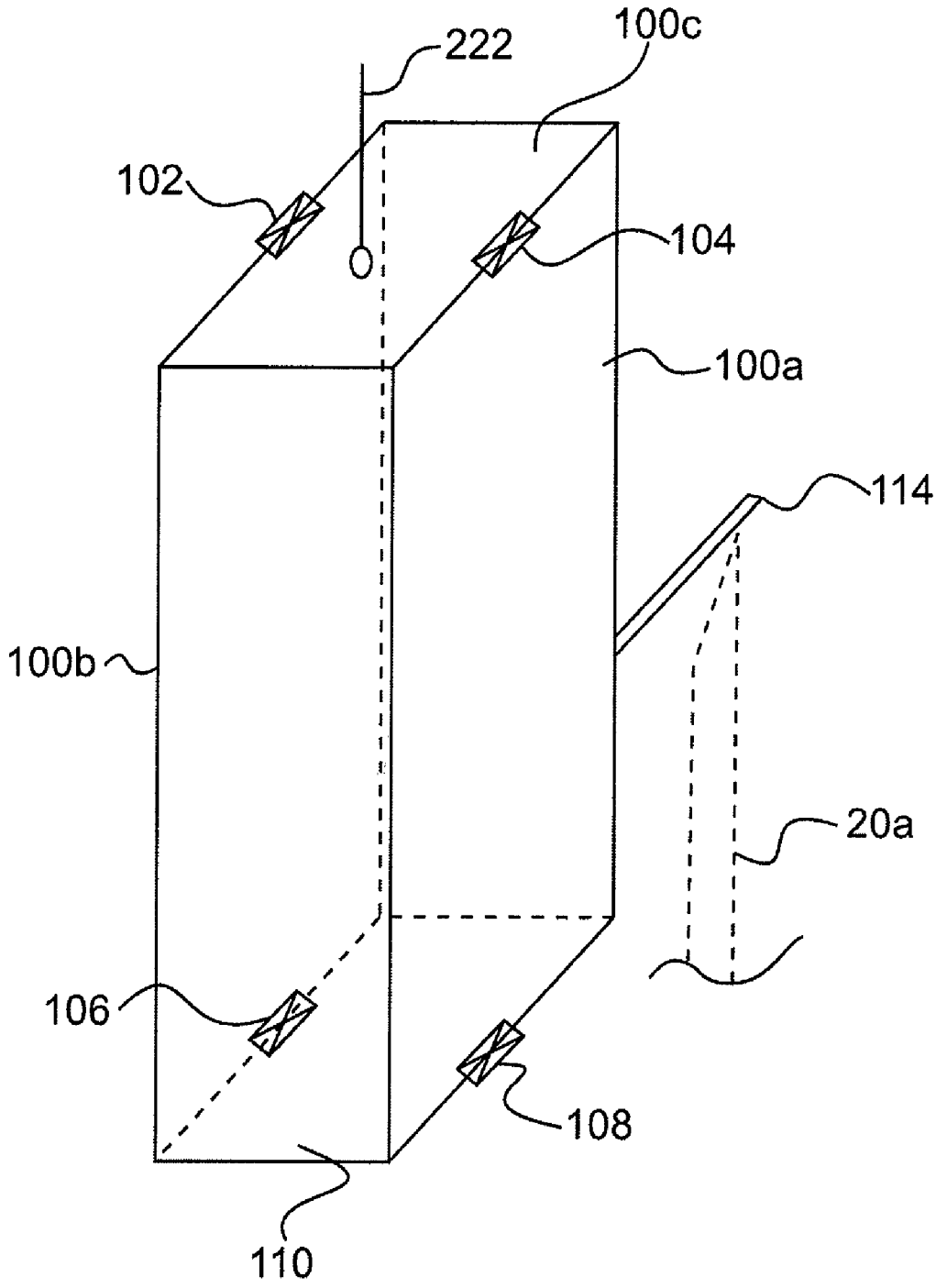
FIG. 1*b* shows a perspective view of the holder in accordance with the invention.

FIGS. 1*a* and 1*b* show a holder generally depicted as reference numeral 100. The holder 100 is in the expanded position and, in one embodiment, may have a maximum width of approximately two inches. In the collapsible configuration, though, the holder may be approximately the width of the object loaded therein. In one example, the holders are designed to hold mail pieces, magazines, packages or other objects (collectively referred to as "flats").

The holder 100 includes opposing side surfaces 100*a* and 100*b* and a top surface 100*c*. In one aspect of the invention, the opposing side surfaces 100*a* and 100*b* are mounted to the top surface 100*c* via hinges 102, 104. A drop down or releasable bottom 110 may be mounted to the opposing side surfaces 110*a* and 100*b* by hinges 106 and 108. The releasable bottom 110 is designed to unload the flats from the holder, for example.

Figure 3:
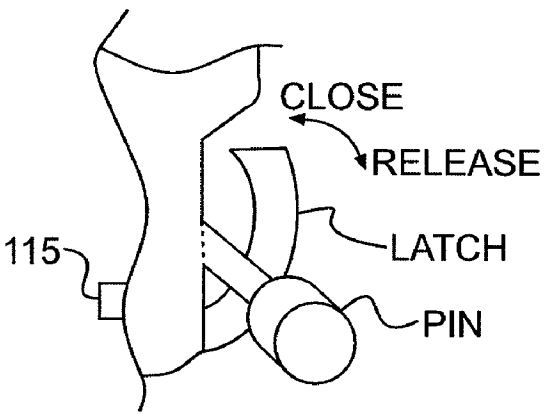
FIG. 3 shows a hinge mechanism used with the holder in accordance with the invention.

To release the bottom 110, an actuator 112 may be actuated which releases the hinge 108, for example. The hinge 108 may be, for example, a pin "P and latch "L" assembly, as shown in FIG. 3. The actuator may be a solenoid, or a hydraulic or pneumatic mechanism. In this type of assembly, the latch "L" is moveable to release the pin "P" in order to drop the bottom portion 110, as represented by the dashed line in FIG. 1*a*. The bottom portion 110 may be closed by a linear actuator, hydraulic system, or the like represented as reference "A", or a stationary platform (FIGS. 4 and 5), for example.

As shown in FIG. 1*b*, in one aspect of the invention, a bar 114 or other protrusion may extend from the sidewall of the holder 100. A platform 200, represented by dashed lines, may be in intermittent mechanical communication with the bar 114 in order to place the holder in the expanded position. This may be accomplished at the induction and ejection positions of a transport system.

Figure 2:
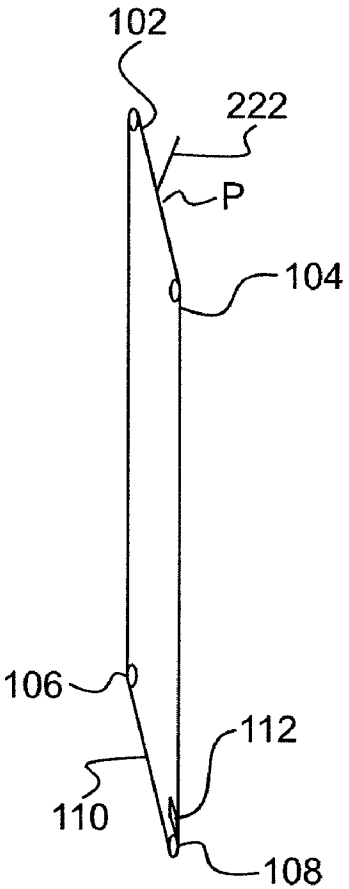
FIG. 2 shows the holder in a collapsed configuration in accordance with the invention.

FIG. 2 shows the holder 100 in a collapsible configuration, with hinges 102 and 106 raised and hinges 104 and 108 lowered. It should be understood from the configuration of the hinges, that the collapsed state of FIG. 2 may be the result of gravity or, equally, by placement of a flat within the holder. In the latter scenario, by placing a flat within the holder 100, the collapsed configuration will automatically result without the requirement of any actuators or the like. This is due, at least in part, to the weight of the flat focused about the hinge 108, for example.

In the collapsed state, the opposing side walls or surfaces 100*a* and 100*b* remain substantially parallel to one another, similar to that of the expanded configuration shown in FIGS. 1*a* and 1*b*. Similarly, in the collapsed state, the top wall or surface 100*c* remains substantially parallel with the bottom surface 110, similar to that of the expanded configuration shown in FIGS. 1*a* and 1*b*. The holder may pivot about point "P" via a hanger or other hanging mechanism 222, which is designed so that upon placement of a flat in the holder, the hinges 102 and 106 will raise and the hinges 104 and 108 will lower resulting in a collapsed holder, enveloping the flat.

Figures 4A, 4B, 4C, 4D, 4E, 4F:
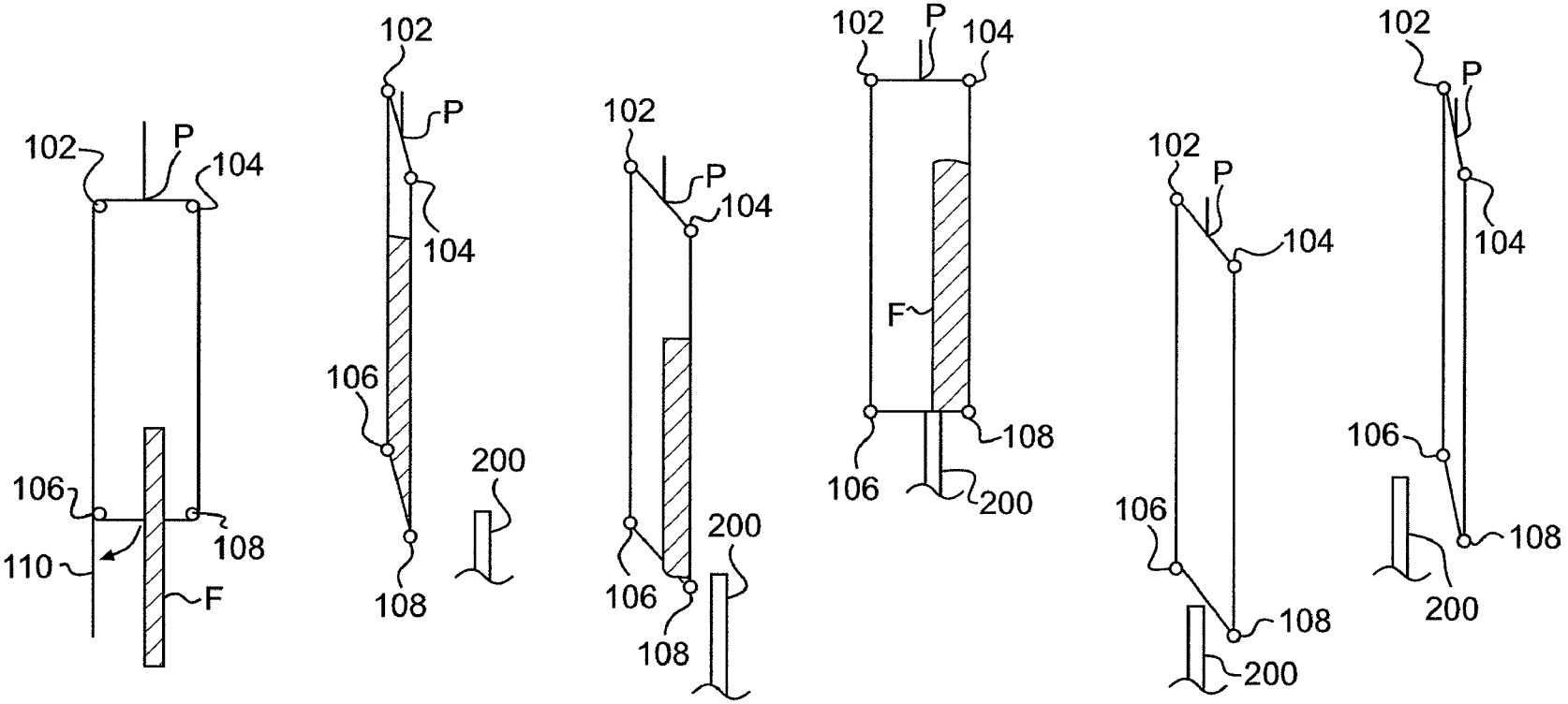
FIGS. 4*a*-4*f* show the holder during several operation phases in accordance with the invention.

FIGS. 4*a*-4*e* show the holder 100 during several operational stages. In FIG. 4*a*, the holder is in a collapsed state prior to loading flats therein. In FIG. 4*b*, the holder begins to expand in order to load flats therein, about pivot P. This expanded configuration may be accomplished by passing over a stationary platform 200, for example. More particularly, as the holder approaches (in direction of arrow "A") and then passes over a stationary platform 200, which is approximately a height at the bottom 110, the bottom 110 will contact the platform and begin to rise to the height of the platform 200. As the bottom rises, the entire holder will expand due to the hinged configuration, as shown in FIG. 4*c*. The expansion of the holder 100 may also be accomplished by the bar 114 contacting the stationary platform, in a similar manner described above.

In the expanded position, as shown in FIG. 4*c*, a flat "F" may be loaded therein. In FIG. 4*d*, the holder 100 begins to collapse with the flat "F" loaded therein as it moves away from the platform. This is due to a combination of:

1. the hinge configuration of the holder,
2. a flat loaded therein which provides a downward force on the hinge 106 or 108, for example,
3. the pivot, and/or
4. gravity, in some instances.

As the holder fully collapses, the holder now tightly envelops the loaded flat "F" as shown in FIG. 4*e*. This collapsed state considerably reduces the overall width of the holder to that of substantially the flat and sidewalls.

The holder may be expanded, again, at an unloading point in the system, e.g., the packager at which time, the bottom portion 110 would be released at this operational stage (FIG. 4*f*). The bottom portion 110 may be closed manually, by moving past the platform or by a linear actuator, hydraulic system or the like represented as reference "A" (FIG. 1*a*), for example, such that in any scenario the pin will engage the latch.

As should now be understood, in this sequence, the flats are inducted into the holders when they are set to maximum width, to allow for the thickest flat (FIG. 4*a*) to be properly placed therein. Following holder fill, the holder width is reduced to approximately the actual thickness of the flat (FIG. 4*d*). The holder can then be stored in this reduced width configuration so that storage space is conserved. When the flat is to be ejected, the holder width is again expanded so that the flat can be easily ejected (FIG. 4*f*).

Figure 5:
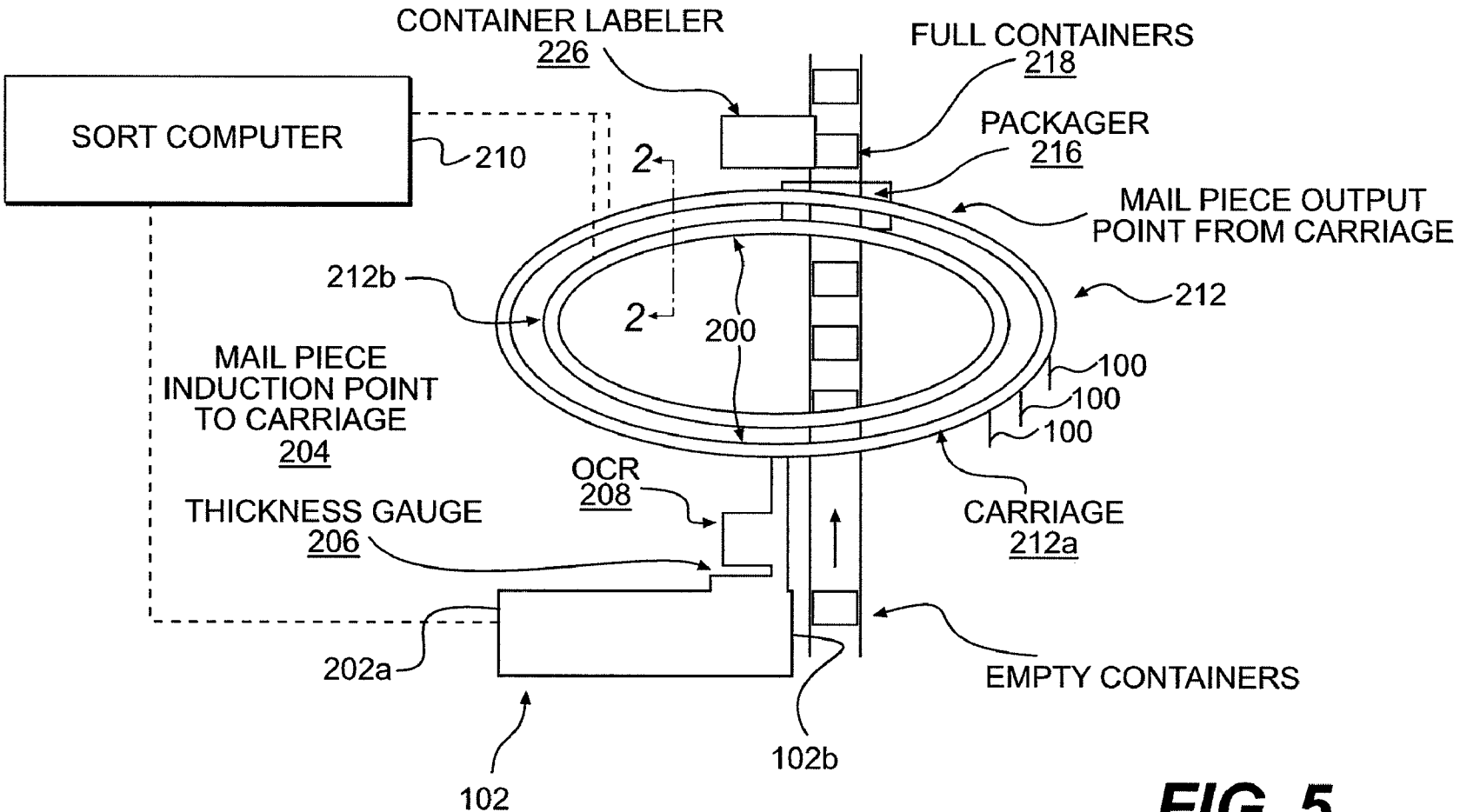
FIG. 5 shows an illustrative system using the holder in accordance with the invention.

FIG. 5 is representative of a system using the holders of the invention. It should be realized that the system shown in FIG. 5 is one example of several systems which can benefit from the use of the holders. For example, the holders can be implemented in a one or two pass algorithm system, known to those of skill in the art. As such, the system of FIG. 5 should not be considered a limiting feature of the invention and is provided as one illustrative example. In one aspect, the system may be representative of the system disclosed in U.S. patent application Ser. No. 10/265,570, which is incorporated by reference herein in its entirety.

In one system shown in FIG. 5, one or more feeders 202 are positioned at a beginning of the process. The feeder(s) 202 may be any known feeder that is capable of transporting flats from a first end 202*a* to a second, remote end 202*b*. In embodiments, the feeder(s) 202 is capable of feeding the stream of flats at a rate of approximately 10,000 per hour. Of course, those of skill in the art should recognize that other feed rates and multiple feeders, depending on the application, might equally be used with the invention. A transport system or feed track 204 is positioned downstream from the feeder(s) 202, and preferably at an approximate 90° angle therefrom. This angle minimizes the use of valuable flooring space within the processing facility. The feed track 204 may also be at other angles or orientations, depending on the flooring configuration of the processing facility.

Still referring to FIG. 5, a flat thickness device 206 and a scanning device 208 such as, for example, an optical character recognition device (OCR), bar code scanner or the like is provided adjacent or proximate the feed track 204. In embodiments, the flat thickness device 206 measures the thickness of each flat as it passes through the system, and the OCR 208 reads the address or other delivery information which is located on the flat. The flat thickness device 206 may be any known measuring device such as a shaft encoder, for example. The flat thickness device 206 and the OCR 208 communicate with a sorting computer 210 via an Ethernet, Local Area Network, Wide Area Network, Intranet, Internet or the like. The flat thickness device 206 and the OCR 208 provide the thickness and address information to the sort computer 210, at which time the sort computer 210 assigns a virtual code to the flat for delivery and sorting purposes. This is provided via a look-up table or other known method. It should be understood by those of skill in the art that the sort computer only requires the address information to provide the virtual code.

FIG. 5 further shows the platform 200 in relation to a cell movement mechanism 212 and the induction point of the feed transport 204. The platform 200 is preferably placed at a remote end 204*a* of the feed transport 204 near the loading point of the holders, which extend from the carriages. The platform is at a height to effectuate the expansion of the holder, as discussed above. Due to the many different system variations, this height may vary accordingly.

Any number of holders 100 may extend from the carriage; but, in one preferred embodiment, approximately 1000 holders are provided. The holders 100 are designed to (i) expand and collapse to conserve space, (ii) capture and hold the flats as they are conveyed from the feed transport 104, (iii) move about the carriage 112*a*, as well as (iv) move between the carriage 112*a* and the carriage 112*b*. By reducing the width of the holders, overall length of the system can be significantly reduced resulting in a smaller system foot print. In one aspect, the total size (e.g., footprint) of the system may be reduced by a minimum of 50%.

A portion of the cell movement mechanism 212 may also be positioned, partly, at approximately the same location as the platform 200 (induction point). The cell movement mechanism 212 may be any shape such as an oval shape shown in FIG. 5, or other shapes such as, for example, a loop configuration, e.g., circular, serpentine and the like, in line or other shapes that are designed for certain flooring spaces. In one embodiment, the overall track may be any length, but in one implementation the track may be a diameter of approximately 25 feet. Multiple systems may also be nestable; namely, the system of the invention may be stacked vertically to more efficiently utilize the flooring space of the processing facility.

The cell movement mechanism 212 may include one or more carriages. In the representative embodiment, a two carriage system is shown with a first carriage 212*a* and a second carriage 212*b*. However, this representation may equally represent a single carriage system. The first carriage 212*a* may transport the flats in one direction (e.g., when in a loop configuration) or bi-directionally (e.g., when in a line configuration). An optional packager 216 is provided at a predetermined position with respect to the cell movement mechanism 212, and preferably aligned with the first carriage 212*a*. (Those of skill in the art will recognize that multiple packagers can also be used with the invention.) A second platform 200 may be positioned proximate the packager 200 for expanding the holder for unloading of the flats.

The packager 216 is designed to package the flats as they are unloaded from either carriage, via the releasable bottom 110 of the holders 100. The packager 216 then transports the flats to containers 218 that are provided with a label at container labeler 220. In embodiments and due to the tracking of the thickness of each flat, the system of the invention is capable of determining the height of the flats in each container 218 thus ensuring maximum use of each container.

Figure 6:
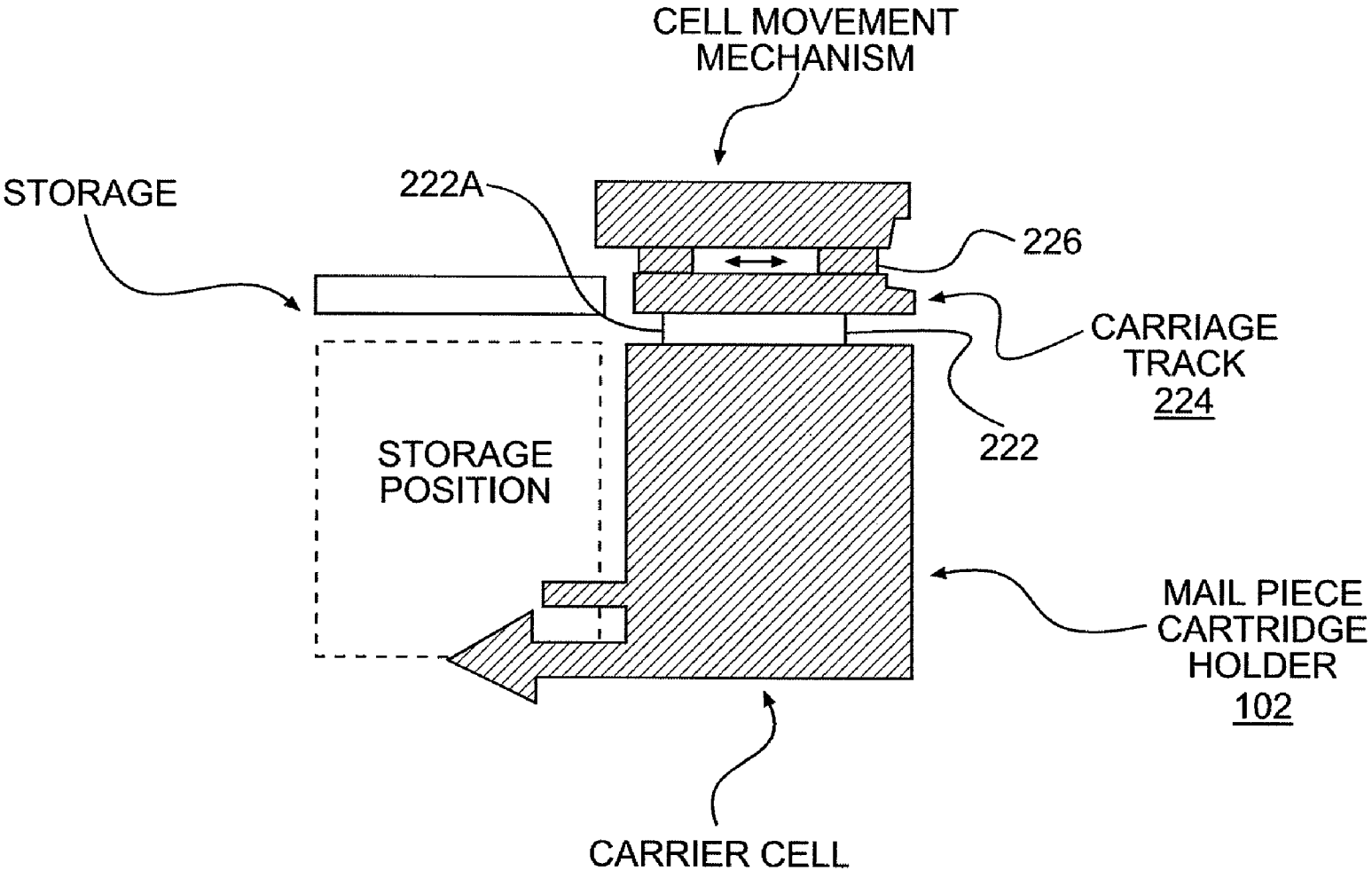
FIG. 6 is a cross sectional view of the system of FIG. 5, along line A-A.

FIG. 6 shows a sectional view of the holder 100 extending downward from either of the carriages. It should be understood that FIG. 6 may represent the holder extending only from one carriage. In one aspect of the invention, "hangers" 222, are suspended from a bar or track 224, which allow the holders to suspend and/or slide between respective carriages. In one embodiment, the hangers may include wheels or bearings, depicted as reference numeral 222*a*, instead of a "hooked" portion. (The hooked portion, provided about the track, may also be depicted as reference numeral 222*a*.) The wheels or bearings facilitate the movement of the hangers 222 and hence the holders 214 between the tracks of the carriages. Such components of hangers are manufactured by Tirnken Company of Canton Ohio, for example, and are used by Lockheed Martin Corporation.

The hangers 222 may be transported by sliding between the carriages by known mechanisms such as, for example, linear actuators, solenoids or piston and cylinder assemblies, as depicted at reference numeral 226. The linear actuators, solenoids or piston and cylinder assemblies may be packaged in the cell movement mechanism 212 and communicate with the holders 100 and, in one application, directly with the hangers, themselves. The linear actuators, solenoids or piston and cylinder assemblies push or pull the hangers, depending on the position between the respective carriages. Such linear actuators, solenoids or piston and cylinder assemblies are manufactured by Tol-o-matic Fluid Power Products of Hamel Minn., for example, and are implemented in various applications by Lockheed Martin Corporation. The hangers 222 may also simply be manually moved, although less efficient than an automated means of moving the holders.

As further shown in FIG. 6, when using two carriages, in one implementation, the spacing between the hangers 222 for each of the holders 100 may be larger than the spacing between the first carriage 212*a* and the stationary carriage 212*b*. This will allow the holders 100 and more specifically the hangers 222 of each of the holders 100 to span the gap between the tracks of the aligned carriages 212*a* and 212*b*, ensuring the stability of the system. Said otherwise, the hangers 222 are designed to allow them to span or bridge the gap or space between the carriages 212*a* and 212*b* thus ensuring that the hangers are always stably "hooked" to one of the carriages 212*a* and 212*b*. The hangers may represent the pivot point P", as shown in FIG. 2, for example, and are also designed for the use with one carriage.

Operation of Use

Figure 7:
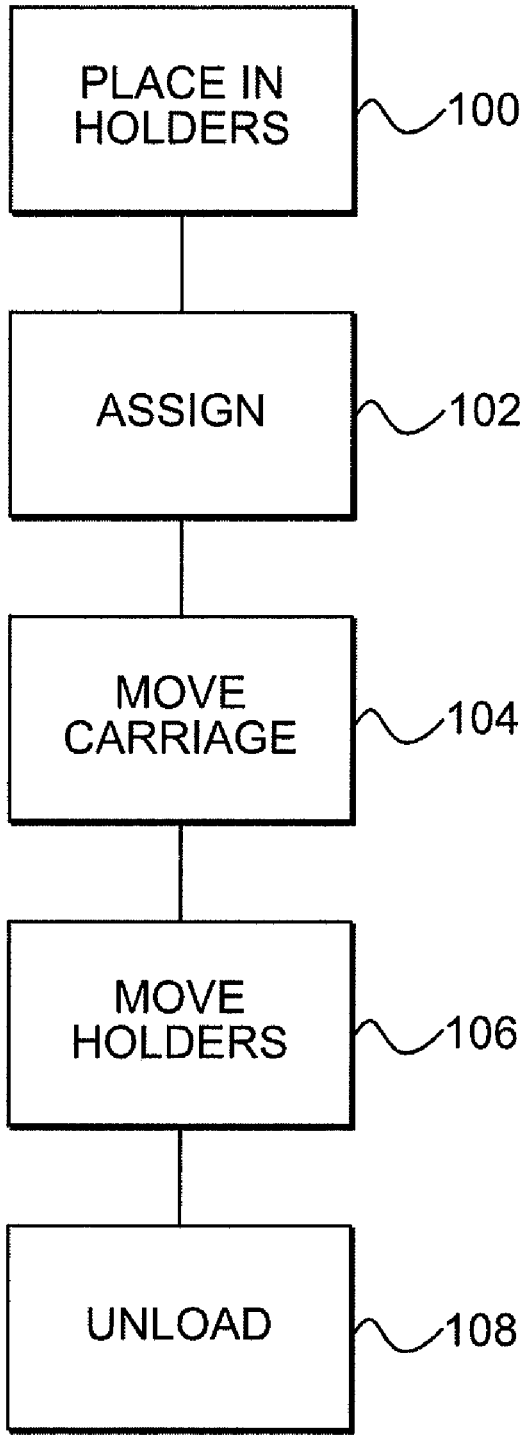
FIG. 7 is a flow chart implementing the steps of the invention using the system of the invention.

FIG. 7 is a flow diagram showing the steps implemented by the invention. The steps of the invention may be implemented on computer program code in combination with the appropriate hardware. This computer program code may be stored on storage media such as a diskette, hard disk, CD-ROM, DVD-ROM or tape, as well as a memory storage device or collection of memory storage devices such as read-only memory (ROM) or random access memory (RAM). Additionally, the computer program code can be transferred to a workstation or the sort computer over the Internet or some other type of network. FIG. 7 may equally represent a high-level block diagram of the system of the invention, implementing the steps thereof.

In step 100, of FIG. 7, non-sequenced flats are placed in the expanded holders extending from the carriage. In step 102, the sort computer assigns codes or the like to the holders and positions on the carriage(s) based on the flat information and sequencing thereof. Once the flats are loaded into the holder, the holder will collapse in accordance with the above description, for example. In step 104, the carriage 112*a* incrementally moves and is aligned with corresponding positions on another carriage or storage area or feeder, for example. In step 106, the holders are moved in order to provide a sort and/or sequencing using any well known method. Steps 104 and 106 may be repeated until the holders carrying the flats for a delivery route, for example, are sequenced on either of the carriages. In step 108, the holders are expanded by passing the platform, and the flats are sequentially loaded into the packager, via the releasable bottom. The bottom may be controlled by the sort computer, knowing the position of the holder over the packager and then activating the solenoid.

It should be understood that the ordering of the flats, in sequence, may occur when the holders are moved between the carriages based on the codes assigned to the holders and positions on the respective carriages, as determined by the sort computer. Also, if there is only one carriage, then the flats would be unloaded from the holders and passed through the feeders for further induction, in accordance with any well known two pass algorithm sequence.

While the invention has been described in terms of embodiments, those skilled in the art will recognize that the invention can be practiced with modifications and in the spirit and scope of the appended claims.

What is claimed:

1. An expandable and collapsible holder, comprising a top surface having opposing ends hinge mounted to opposing side surfaces, and a releasable bottom surface hinge mounted to the opposing side surfaces by a hinge and a releasable latch mechanism at an end remote from the top surface, wherein the releasable latch mechanism and the hinge maintain a hinged connection of the releasable bottom surface to the opposing side surfaces during operation from an expandable state to a collapsible state of the expandable and collapsible holder.

2. The holder of claim 1, wherein the releasable latch mechanism enables the bottom surface to disengage from the releasable latch mechanism.

3. The holder of claim 1, further comprising a bar extending from one of the opposing side surfaces to enable expansion.

4. The holder of claim 1, wherein the top surface, opposing side surfaces and the bottom surface form a substantial rectilinear shape when in the expanded position.

5. The holder of claim 1, wherein:

the top surface and the bottom surface remain parallel to one another in a collapsed and expanded position; and the opposing side surfaces remain parallel to one another in the collapsed and expanded position.

6. The holder of claim 1, further comprising a pivot about the top surface, the holder expanding and collapsing about the pivot.

7. The holder of claim 1, further comprising a hanging mechanism attached at a fulcrum point of the top surface.

8. The holder of claim 1, further comprising a mechanism which closes the releasable bottom surface.

9. The holder of claim 1, wherein the releasable bottom surface is a drop down bottom.

10. The holder of claim 1, wherein the releasable latch mechanism is a pin and latch assembly.

11. The holder of claim 1, wherein the releasable latch mechanism is a second hinge mounted on an opposing side from the hinge.

12. The holder of claim 1, wherein the releasable latch mechanism keeps the releasable bottom surface connected to one of the opposing side surfaces when the expandable and collapsible holder is in the collapsed state.

13. The holder of claim 12, wherein the releasable latch mechanism releases the releasable bottom surface from the one opposing side surface when the expandable and collapsible holder is in the expandable state.

14. The holder of claim 13, wherein the hinge maintains a hinged connection of the releasable bottom surface to the opposing side surfaces when the expandable and collapsible holder is in the expandable state and the collapsed state.

15. The holder of claim 13, wherein only the releasable bottom surface is opened in when the expandable and collapsible holder is in the expandable state.

16. The holder of claim 13, wherein the top surface, opposing side surfaces and the releasable bottom surface are closed when the expandable and collapsible holder is in the collapsible state.

17. The holder of claim 1, wherein the releasable latch mechanism is a pin and a movable latch that remains engaged with the pin when the expandable and collapsible holder is in the collapsed state thereby preventing the releasable bottom surface from disconnecting from one of the opposing side surfaces when in the collapsed state.

18. The holder of claim 17, wherein the movable latch remains engaged with the pin during operation from the expandable state to the collapsible state.

19. The holder of claim 18, wherein the movable latch moves to release the pin when the expandable and collapsible holder is in the expanded state to thereby open the releasable bottom surface.

20. An expandable and collapsible holder, comprising a top surface having opposing ends hinge mounted to opposing side surfaces, a releasable bottom surface hinge mounted to the opposing side surfaces by at least a releasable latch mechanism at an end remote from the top surface, and an actuator for releasing the latch mechanism at a predetermined location or time.

21. The holder of claim 20, wherein the actuator is a solenoid.

22. A holder for transporting mail pieces, comprising:

a top wall;

opposing side walls hinge mounted to ends of the top wall;

a releasable, bottom wall hinge mounted to each of the opposing side walls, remote from the top wall, one of the hinge mountings being a releasable latch mechanism; and an actuator positioned proximate to the releasable latch mechanism controlling the opening of the releasable latch mechanism at a predetermined location or time to open the releasable, bottom wall.

23. The holder of claim 22, further comprising a bar extending from one of the opposing side walls to enable expansion thereof when in intermittent mechanical communication with a stationary platform.

24. The holder of claim 22, wherein: the top wall and the releasable, bottom wall remain parallel to one another in a collapsed and expanded position; and the opposing side walls remain parallel to one another in the collapsed and expanded position.

25. The holder of claim 22, further comprising a fulcrum associated with the top wall in order to allow a pivot about a location on the top wall, the holder expanding and collapsing about the pivot.

26. The holder of claim 22, further comprising a mechanism attached to the bottom wall which closes the releasable, bottom wall after opening thereof.

27. The holder of claim 22, wherein the actuator is a solenoid.

28. The holder of claim 22, wherein the releasable latch mechanism is a pin and latch assembly.

* * * * *